US009931877B2

(12) United States Patent
Stork et al.

(10) Patent No.: US 9,931,877 B2
(45) Date of Patent: Apr. 3, 2018

(54) HEAT-SENSITIVE RECORDING MATERIAL HAVING A NOVEL COLOR ACCEPTOR COMBINATION

(71) Applicant: MITSUBISHI HITEC PAPER EUROPE GMBH, Bielefeld (DE)

(72) Inventors: Gerhard Stork, Flensburg (DE); Diana Valentina Becerra Siabato, Flensburg (DE); Matthias Neukirch, Flensburg (DE)

(73) Assignee: Mitsubishi HiTec Paper Europe GmbH, Bielefeld (DE)

( * ) Notice: Subject to any disclaimer, the term of this patent is extended or adjusted under 35 U.S.C. 154(b) by 0 days.

(21) Appl. No.: 15/118,740

(22) PCT Filed: Feb. 10, 2015

(86) PCT No.: PCT/EP2015/052750

§ 371 (c)(1),
(2) Date: Aug. 12, 2016

(87) PCT Pub. No.: WO2015/124462

PCT Pub. Date: Aug. 27, 2015

(65) Prior Publication Data

US 2017/0043601 A1 Feb. 16, 2017

(30) Foreign Application Priority Data

Feb. 21, 2014 (EP) ..... 14156227

(51) Int. Cl.
*B41M 5/333* (2006.01)
*B41M 5/327* (2006.01)

(52) U.S. Cl.
CPC ..... *B41M 5/3331* (2013.01); *B41M 5/3275* (2013.01); *B41M 5/333* (2013.01); *B41M 5/3333* (2013.01); *B41M 5/3335* (2013.01); *B41M 2205/04* (2013.01)

(58) Field of Classification Search
CPC .. B41M 5/333; B41M 5/3331; B41M 5/3333; B41M 5/3335; B41M 2205/04
USPC ..... 503/216
See application file for complete search history.

(56) References Cited

U.S. PATENT DOCUMENTS

2004/0258857 A1 12/2004 Dagan et al.

FOREIGN PATENT DOCUMENTS

| | | |
|---|---|---|
| CN | 1471476 | 1/2004 |
| CN | 1474751 | 2/2004 |
| CN | 1547529 | 11/2004 |
| EP | 2 574 645 | 4/2013 |

OTHER PUBLICATIONS

Office Action dated Jan. 10, 2018 which issued in the corresponding Chinese Patent Application No. 201580009022.7.

*Primary Examiner* — Bruce H Hess
(74) *Attorney, Agent, or Firm* — Cozen O'Connor

(57) ABSTRACT

A heat-sensitive recording material including a web-shaped substrate having a front side and an opposite reverse side, and at least one heat-sensitive recording layer on either or both of the sides of the web-shaped substrate.

The heat-sensitive recording layer contains a color acceptor having a combination at least consisting of one, two, three or more than three color acceptor (compounds) of formula (1)

formula (1)

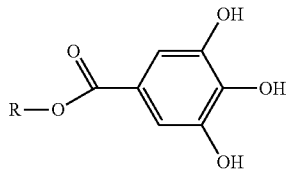

where R is alkyl, and of at least one secondary color acceptor comprising lactic acid oligomers conforming to formula (3)

formula (3)

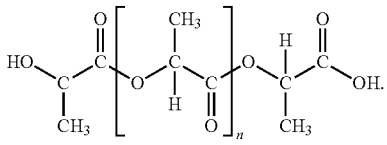

$n = 4\text{-}50$

17 Claims, No Drawings

HEAT-SENSITIVE RECORDING MATERIAL HAVING A NOVEL COLOR ACCEPTOR COMBINATION

CROSS REFERENCE TO RELATED APPLICATION

This is a U.S. national stage of application No. PCT/EP2015/052750, filed on Feb. 10, 2015. Priority is claimed on European Application No.: EP14156227.2, filed Feb. 21, 2014, the content of which is incorporated here by reference.

BACKGROUND OF THE INVENTION

1. Field of the Invention

The invention relates to a heat-sensitive recording material comprising a web-shaped substrate and at least one heat-sensitive recording layer on either or both of the sides of the web-shaped substrate, and provides that this heat-sensitive recording layer contain a novel type of color acceptor combination.

2. Description of the Prior Art

Recording materials that are heat sensitive and react color-formingly to the external supply of heat have been known for many years and enjoy a basically undiminished popularity, inter alia because their use is associated with immense advantages for businesses issuing tickets and/or sales receipts. Since the color-forming components, i.e., the dye precursors as well as the color acceptors that react therewith on heating, also known as (color) developers, reside in the recording material itself in such a heat-sensitive recording process, the thermal printers, which are free from toner and ink cartridges and which do not require regular servicing, can be installed in large numbers. This innovative technology has thus become pervasive in the retail trade and in public transport in particular.

In the recent past, however, increasing concerns have been raised about the environmental compatibility of certain color acceptors, and these, while not necessarily being science based, cannot simply be disregarded by the industry and particularly by commerce. Particularly heat-sensitive recording materials containing

- bisphenol-A, i.e., 2,2-bis(4-hydroxyphenyl)propane, and
- bisphenol-S, i.e., 4,4'-dihydroxydiphenyl sulfone, have attracted criticism, and this led primarily to an increased use of
- Pergafast® 201, i.e., N-(p-toluenesulfonyl)-N'-3-(p-toluenesulfonyloxyphenyl)urea, from BASF Corporation, and
- D8, i.e., 4-[(4-(1-methylethoxy)phenyl)sulfonyl]phenol.

EP 2 574 645 A1 proposes a heat-sensitive recording material comprising a substrate supporting a heat-sensitive recording layer comprising a dye precursor and a color acceptor. The color acceptor contains a molecule from an n-basic acid and oligomers of polylactic acid which are grouped n-fold around said acid or is formed by the molecule. The disclosure of this document similarly reveals that a color acceptor as described above is optionally combinable with other color acceptors selected from the list comprising:

- bisphenol-A, i.e., 2,2-bis(4-hydroxyphenyl)propane,
- bisphenol-S, i.e., 4,4'-dihydroxydiphenylsulfone,
- Pergafast® 201, i.e., N-(p-toluenesulfonyl)-N'-3-(p-toluenesulfonyloxyphenyl)urea, from BASF Corporation, and
- D8, i.e., 4-[(4-(1-methylethoxy)phenypsulfonyl]phenol, except that such a possible combination will not be very important in commercial practice with regard to bisphenol-A and bisphenol-S, since the marketplace is interested in heat-sensitive recording materials where the color acceptors are environmentally friendly to a particular degree. The otherwise highly informative document does not reveal any prompt whatsoever regarding the combination of color acceptors based on oligomers of polylactic acid with further color acceptors beyond the components listed above.

US 2005 282,704 A1 discloses the possible use of copolymers of polylactic acid as energy absorbers in heat-sensitive recording materials. German Laid-Open Specification DE 22 53 772 A1 proposes a recording sheet having a color developer layer, which in addition to an acidic polymer, contains a metal salt or an organic acid of carbon, for example an aliphatic carboxylic acid, specifically inter alia 2-hydroxy-2,4-dimethylpentanoic acid.

US 2004/258,857 A1 proposes a nonreactive recording material whose elastic substrate comprises polylactic acid. US 2005/112,302 A1 in turn discloses an inkjet recording element the ink-permeable coating of which comprises a material based on polylactic acid.

SUMMARY OF THE INVENTION

In response to this abrupt change in the marketplace, the inventors recognized the need for further heat-sensitive recording materials where the color acceptor within the heat-sensitive recording layer is ideally fully biodegradable and not environmentally burdensome and where the cost of manufacture is at least still acceptable economically, since, after all, even the best products have to remain affordable to the customer and/or the consumer.

The problem addressed by the present invention in relation to the prior art described above is solved according to at least one aspect of the present invention by proposing a heat-sensitive recording material comprising

- a web-shaped substrate having a front side and an opposite reverse side,
- at least one heat-sensitive recording layer on either or both of the sides of the web-shaped substrate, characterized in that the heat-sensitive recording layer contains a color acceptor comprising a combination at least consisting

- of one, two, three, or more than three color acceptor (compounds) of formula (1)

formula (1)

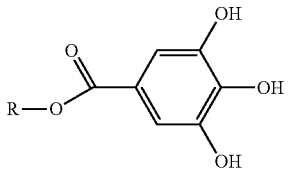

where R is alkyl,

- and of at least one secondary color acceptor comprising lactic acid oligomers conforming to formula (3)

formula (3)

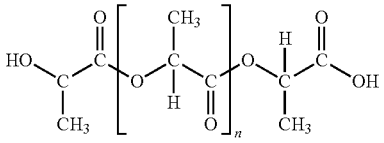

$n$ = 4-50

Alkyl R in formula (1) comprises with preference from 1 to 25 carbon atoms and with very particular preference from 10 to 20 carbon atoms. A known color acceptor compound of this type, which is also very particularly preferable for the purposes of the present invention, is the stearyl ester of gallic acid, or stearyl gallate. Compounds of formula (1) are substances based on natural products and used particularly as antioxidants in food products, including for instance ethyl gallate (E 313), propyl gallate (E 310), octyl gallate (E 311) and dodecyl gallate (E 312) for use inter alia in bread, cakes, pastries, margarine, marzipan, nougat, instant soups, and chips/crisps.

In a very particularly preferable embodiment of the invention, the problem addressed is solved by a heat-sensitive recording material comprising a web-shaped substrate having a front side and an opposite reverse side, and at least one heat-sensitive recording layer on either or both of the sides of the web-shaped substrate, characterized in that the heat-sensitive recording layer contains a color acceptor comprising a combination at least consisting of one, two, three, or more than three color acceptor (compounds) of formula (1)

formula (1)

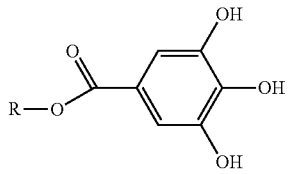

where R is alkyl, and of at least one secondary color acceptor comprising a molecule or formed from a molecule from an n-basic acid and from lactic acid oligomers grouped n-fold around said acid and conforming to formula (3)

formula (3)

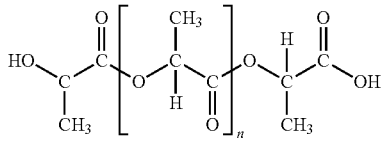

$n = 4\text{-}50$

To provide further understanding of the present invention, it may first be noted that lactic acid can be represented as conforming to formula (2)

formula (2)

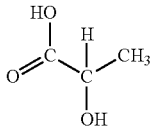

Lactic acid

Polylactic acid is a fully biodegradable plastic as a specific embodiment of polyester, in particular when the polylactic acid is a compound formed from dextrorotatory lactic acids (L-(+)-lactic acid), which is deemed very particularly preferable for the purposes of the present invention. Since each polylactic acid has a nonutilizable hydroxyl group at one end of its long polymeric molecule and at the other end a carboxyl group deemed reactive with the dye precursors only, a preferred embodiment of the invention employs oligomers of lactic acid as a secondary color acceptor or as part of the secondary color acceptor. These oligomers of lactic acid can be represented as conforming to formula (3):

formula (3)

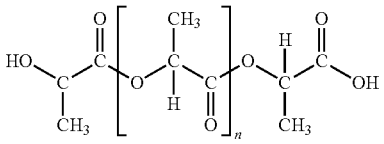

$n = 4\text{-}50$

Following intensive investigations, then, the present inventors recognized that it is particularly advantageous to increase the number of utilizable carboxyl groups by grouping the oligomers of lactic acid n-fold around an n-basic acid—and this, as noted above, must be deemed a very particularly preferred embodiment of the present invention.

Examples of dibasic acids preferred within this very particularly preferred embodiment are acids selected from the list comprising:

oxalic acid, malonic acid, succinic acid, glutaric acid, adipic acid, pimelic acid, suberic acid, azelaic acid, sebacic acid, undecanedioic acid, dodecanedioic acid, tridecanedioic acid, tetradecanedioic acid, and hexadecanedioic acid.

Such a molecule can then be represented as conforming to formula (4):

formula (4)

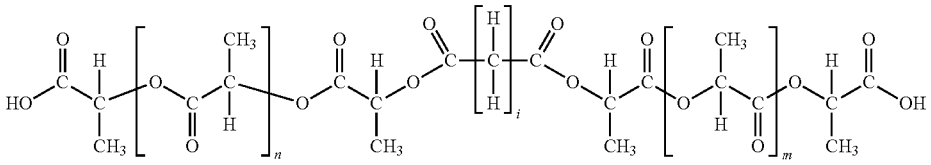

$n = 1\text{-}50$
$m = 1\text{-}50$
$i = 0\text{-}18$

Further examples of a dibasic acid are such acids selected from the list comprising:

maleic acid, fumaric acid, malic acid, tartaric acid, glutamic acid, aspartic acid, phthalic acid, isophthalic acid, and terephthalic acid.

Oxalic acid is a very particularly preferred example of a very useful dibasic acid for the purposes of the present invention, leading to a secondary color acceptor molecule from a central oxalic acid molecule and two oligomers of lactic acid. Such a molecule is deemed to be a very particularly preferred example of a secondary color acceptor in accordance with the present invention and is capable of reacting together with a color acceptor compound conforming to formula (1), in particular and very particularly preferably together with a stearyl gallate ester and with a dye precursor to form a visually recognizable color. In addition to a color acceptor compound conforming to formula (1) and a secondary color acceptor from a central oxalic acid molecule and two oligomers of lactic acid, the heat-sensitive recording layer within the purview of the present invention may also comprise, as a further constituent, additional, for example conventional, color acceptors as also mentioned.

It is further very particularly preferable for the purposes of the present invention to group the oligomers of lactic acid threefold around a tribasic acid, in particular around citric acid, leading to a secondary color acceptor molecule from a central citric acid molecule and three oligomers of lactic acid. Such a molecule is deemed to be a very particularly preferred example of a secondary color acceptor in accordance with the present invention and capable of reacting together with a color acceptor compound conforming to formula (1), in particular and very particularly preferably together with a stearyl gallate ester and with a dye precursor to form a visually recognizable color. In addition to a color acceptor compound conforming to formula (1) and a secondary color acceptor from a central citric acid molecule and three oligomers of lactic acid, the heat-sensitive recording layer within the purview of the present invention may also comprise, as a further constituent, additional, for example conventional, color acceptors as also mentioned above.

A molecule from a central citric acid molecule and three oligomers of lactic acid can be represented as conforming to formula (5):

formula 5

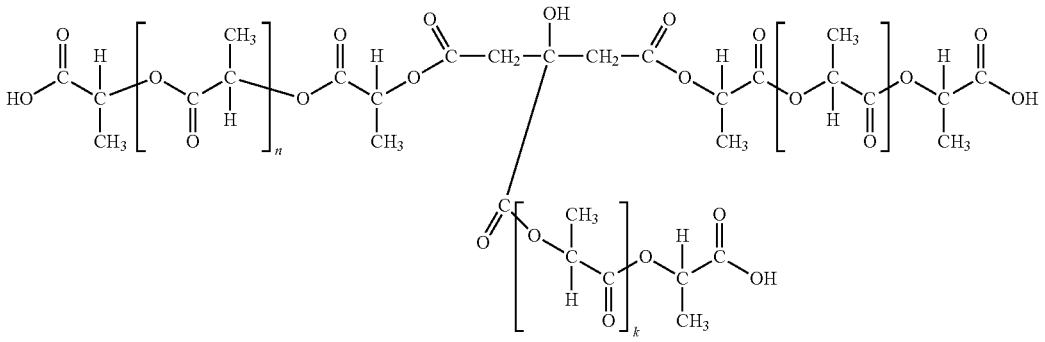

$n$ = 1-50
$m$ = 1-50
$k$ = 1-50

Also conceivable for the purposes of the present invention is a heat-sensitive recording layer containing a color acceptor comprising a combination of one, two, three, or more than three color acceptor (compounds) of formula (1)

formula (1)

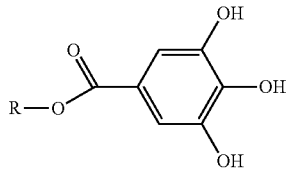

where R is alkyl, and of one first secondary color acceptor containing a molecule or formed from a molecule from an n-basic acid and from lactic acid oligomers grouped n-fold around said acid and of at least one second secondary color acceptor containing a molecule or formed from a molecule from an m-basic acid and from lactic acid oligomers grouped m-fold around said acid subject to the proviso that m≠n. In such a preferred case, rheological factors of the coating composition to form the heat-sensitive recording layer and its sensitivity to the color-triggering heat are precision engineerable. Such an embodiment of the invention, involving two or more molecularly different secondary color acceptors, is similarly a further particularly preferred embodiment of the invention. It is again conceivable here that in addition to a color acceptor compound conforming to formula (1) and the two secondary color acceptors as per the above embodiments, the heat-sensitive recording layer within the purview of the present invention may also utilize, as a further constituent, additional, for example conventional, color acceptors as also mentioned above.

The combination proposed herein, of one, two, three or more than three color acceptor (compounds) of formula (1) and of secondary color acceptors based on lactic acid oligomers conforming to formula (3) in all the embodiments hereinabove elucidated and particularly portrayed as preferred, makes possible a heat-sensitive recording material where the entirety of the color acceptor component within the heat-sensitive recording layer is very largely fully biodegradable and not environmentally burdensome and where manufacturing costs are also economically acceptable. While the color acceptor compounds conforming to formula (1) ensure a completely convincing dynamic printing density for the heat-sensitive recording material, albeit together with the disadvantage of a noticeable and frequently unacceptable yellowing on the part of the heat-sensitive recording material, the secondary color acceptors based on lactic acid oligomers conforming to formula (3) surprisingly prevent this yellowing to a very substantial extent, so a heat-sensitive recording material as proposed is completely convincing not only with respect to its thermal sensitivity but also with respect to its color locus stability. It transpired, in numerous test series underlying this invention, that the wt % (bonedry) ratio of color acceptor compounds conforming to formula (1) to secondary color acceptors comprising lactic acid oligomers conforming to formula (3) in a range extending from 10:1 to 1:1.25 is preferred and from 3.25:1 to 1:1.25 is particularly preferred. An optimum range to obtain the best results particularly with regard to dynamic printing density and a color locus stability without excessive yellowing on the part of the heat-sensitive recording material proposed and particularly in a moist environment extends yet more preferably from 3.25:1 to 1:1 and yet even more preferably from 2.5:1 to 1.25:1.

In the heat-sensitive recording material proposed herein, the heat-sensitive recording layer includes a possible dye precursor comprising preferably at least one substance selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran. 3-Dibutylamino-6-methyl-7-anilinofluoran—also known as ODB-2—is very particularly preferred.

To ensure a convincing dynamic printing density, the heat-sensitive recording layer includes an amount of fluoran-based dye precursor, in particular of 3-dibutylamino-6-methyl-7-anilinofluoran, in a range extending from 0.25 g/m$^2$ to 0.7 g/m$^2$. At the same time, it is very particularly preferred when—independently thereof or, more preferably, at the same time—the wt % (bonedry) ratio of

- fluoran-based dye precursor to the color acceptor compounds conforming to formula (1) is
- in a range extending from 1:1.5 to 1:2.5
- and more preferably in a range extending from 1:1.55 to 1:2.

Simply for just environmental reasons but also made technologically possible by one aspect of the present invention, the heat-sensitive recording material of the present invention may completely eschew sensitizers, which is preferable for and consistent with the purposes of the present invention. If, nonetheless, sensitizers are used, possibly for the purpose of enhancing the thermal sensitivity of response, advisable sensitizers in such a case include particularly for example: 2-(2H-benzotriazol-2-yl)-p-cresol, benzyl p-benzyloxybenzoate, methylolstearamide, stearamide, p-benzylbiphenyl, 1,2-di(phenoxy)ethane, 1,2-di(m-methylphenoxy)ethane, m-terphenyl, dibenzyl oxalate, benzyl naphthyl ether, and dimethyl terephthalate and diphenyl sulfone.

Suitable binders for incorporation in the heat-sensitive recording layer include, for example, water-soluble binders such as starch, hydroxyethylcellulose, methylcellulose, carboxymethylcellulose, gelatin, casein, polyvinyl alcohols, modified polyvinyl alcohols, ethylene-vinyl alcohol copolymers, sodium polyacrylates, acrylamide-acrylate copolymers, acrylamide-acrylate-methacrylate terpolymers and also alkali metal salts of styrene-maleic anhydride copolymer or ethylene-maleic anhydride copolymer, and the binders are usable alone or combined with each or one another; water-insoluble latex binders such as styrene-butadiene copolymers, acrylonitrile-butadiene copolymers and methyl acrylate-butadiene copolymers are also useful as binders for incorporation in the heat-sensitive recording layer. For the purposes of the present invention, polyvinyl alcohol, ethylene-vinyl alcohol copolymers or polyvinyl alcohol combined with ethylene-vinyl alcohol copolymers are particularly preferred binders that are incorporated in the heat-sensitive recording layer in a range extending from 10 to 20 wt %, based on the overall weight of the recording layer.

To improve gliding properties past a thermal head and to avoid excessive wear of the thermal head, the heat-sensitive recording layer may further comprise slip and release agents such as metal salts of higher fatty acids, for example zinc stearate, calcium stearate, and waxes, for example paraffin, oxidized paraffin, polyethylene, polyethylene oxide, stearamides, and castor wax.

Further constituents of the heat-sensitive recording layer in a preferred embodiment in addition to

- the color acceptor combination,
- at least one dye precursor, and
- a binder comprise one or more pigments, preferably inorganic pigments, and most preferably one or more pigments selected from the list comprising kaolin and aluminum (hydr)oxide, of which particularly kaolin is regarded here as particularly suitable. Less suitable yet not foreclosed from the purview of the present invention are

- primarily calcium carbonate, which weakens the color locus stabilization performance of the secondary color acceptor, and
- silicon (di)oxide, which may occasionally give rise to deposits on the thermal printheads, but otherwise produced perfectly good test results. Therefore, assisted by appropriate measures, silicon (di)oxide can also advance into the circle of better suitable pigments.

Regarding the amount of pigment in the heat-sensitive recording layer, a particularly suitable range extends from 8 to 18 wt % (bonedry), based on the overall weight of the heat-sensitive recording layer, the lower limit being dictated by the increasing likelihood of thermal printhead deposits and the upper limit by an increasing reduction in the sensitivity to the heat from the thermal printheads, which causes the printed image.

The coating apparatus to apply the heat-sensitive recording layer may be, in particular, a roller blade coater, a knife coater, a curtain coater, or an airbrush. The basis weight of the heat-sensitive recording layer is preferably between 2 and 6 g/m$^2$ and more preferably between 2.2 and 4.8 g/m$^2$.

In a very particularly preferred embodiment, the heat-sensitive recording material of the present invention includes a pigment-containing interlayer disposed between the substrate and the heat-sensitive recording layer.

Useful pigments for the interlayer include not only organic hollow pigments but also inorganic pigments, the latter selected with preference from the group comprising natural kaolin, calcined kaolin, silicon oxide and particularly bentonite, calcium carbonate and also aluminum hydroxide and particularly boehmite. Such an interlayer can firstly make a positive contribution to leveling the surface to be coated, thereby reducing the amount of coating color that has to be applied for the heat-sensitive recording layer. This is why leveling coaters—roll coaters, knife coaters and (roller) blade coaters for example—command themselves for applying the pigment-containing interlayer. Secondly, the pigments in this interlayer are capable of imbibing the heat-liquefied wax constituents of the heat-sensitive recording layer at the script formation stage and thus promote fast and consistent functioning of the heat-induced recording technique. The basis weight of the pigment-containing interlayer is preferably between 5 and 20 g/m$^2$ and more preferably between 7 and 11 g/m$^2$.

Although not limited to paper as the substrate, it is paper and specifically here a coating basepaper, which has not been surface treated, that is the substrate which has become established on the market not least because of its good environmental compatibility due to its good recycleability, and which is preferable for the purposes of the present invention. A coating basepaper that has not been surface treated is a coating basepaper that has not been treated in a sizepress or in a coating apparatus. Possible substrates for the invention similarly include sheetings for example of polypropylene, polyolefin, and polyolefin-coated papers, without this enumeration being exclusive in character.

The particulars provided in the description and the claims in respect of the basis weight, the wt % (% by weight) and the parts by weight are each based on the "bonedry" weight, i.e., absolutely dry parts by weight. The numerical particulars in this regard in the observations concerning the organic pigments of the pigment-containing interlayer are computed from the "airdry" weight, i.e., airdry parts by weight, minus the weight fraction of water in and around the pigments in their as-supplied form.

The invention is further clarified with reference to the following inventive and comparative examples:

To form a paper web as web-shaped substrate both for inventive and for comparative heat-sensitive recording materials, a paper furnish is mixed up in a mixing vat from *eucalyptus* pulp and other pulp fibers together with fillers and water. Further constituents included in the furnish are resin size for bulk sizing at 0.6 wt % (bonedry), based on the overall weight of the furnish, and also further customary additives, for example pigments and/or optical brighteners. After finalization, the furnish is subsequently sent to a fourdrinier papermachine, where it is processed into a paper web having a basis weight of 69 g/m$^2$.

After gentle calendering, the paper web is sent into a roller blade coater integrated in the papermachine, where it is coated on the front with a pigmented interlayer having a basis weight of 9 g/m$^2$. The coating composition used for this purpose, i.e., to form the interlayer, includes a pigment mixture of hollow pigment and calcined kaolin,
styrene-butadiene latex as binder,
starch as co-binder and further auxiliaries.

The paper web is dried while still within the papermachine, using radiant heaters and in contact with hot rolls, calendered in a multi-roll calendar, and subsequently wound onto a tambour as semi-finished paper.

The semi-finished paper reel thus obtained is sent to a coating machine where the paper web is continuously unwound again into a roller blade coating apparatus where prepared coating compositions each to form heat-sensitive recording layers are each applied at a basis weight of 4.2 g/m$^2$ to the previously applied and already dried pigmented interlayer. The components used for the coating composition used to form the heat-sensitive recording layer are:

| Function | Component | Comparative | Example 1 | Example 2 | Example 3 | Comparative |
|---|---|---|---|---|---|---|
| | | Wt % (bonedry) in the heat-sensitive recording layer | | | | |
| Color former | 3-dibutylamino-6-methyl-7-anilinofluoran | 19.7 | 16.0 | 16.0 | 16.0 | 19.2 |
| Color acceptor | stearyl gallate | 31.4 | 25.5 | 25.5 | 25.5 | — |
| Secondary color acceptor | central oxalic acid molecule and two oligomers of lactic acid | — | 14.6 | 14.6 | 14.6 | 30.5 |
| Binder | ethylene-vinyl alcohol copolymer | 10.5 | 10.5 | 10.5 | 10.5 | 10.5 |
| Pigment | kaolin | 12.3 | — | — | 12.3 | 12.3 |
| | aluminum hydroxide | — | — | 12.3 | — | — |
| | calcium carbonate | — | 12.3 | — | — | — |
| Auxiliaries | slip agents (zinc stearate, waxes, crosslinkers | . . . | . . . | . . . | . . . | . . . |
| Dynamic printing density [ODUs] | . . . | 1.24 | 1.05 | 1.1 | 1.19 | 0.78 |
| Difference of b* component in L*a*b* color space | . . . | +6.8 | +5.7 | +4.2 | +3.9 | +0.8 |

The heat-sensitive recording layer is subsequently dried using a hot air flotation dryer and in contact with hot rolls and calendered in a multi-roll calendar. The final step is to roll up the then finalized inventive and comparative heat-sensitive recording materials.

To evaluate the inventive and comparative heat-sensitive recording materials thus obtained, samples are taken of each as comparatively small strips of paper and presented for further testing.

To measure the dynamic printing density in ODUs (=optical density units, as per DIN 16536-1 as of May 1997), a black and white checkered thermal test printout is prepared in each case using an Atlantek 400 instrument from Printrex (USA), using a thermal head performing at 300 dpi resolution and at 11.7 mJ/mm$^2$ in terms of energy output per unit area. The printing density itself of the black areas is measured using a Gretag MacBeth D19C NB/U densitometer (from Gretag MacBeth, 8105 Regensdorf, Switzerland), by measuring, for each measurement value, the dynamic printing densities at three places and forming the arithmetic mean from the three individual values. The mean values thus obtained are reported in the penultimate row of table 1; they indicate a still acceptable dynamic printing density in the case of Examples 1 to 3, which are in accordance with the present invention, and an undeniable, as yet not completely resolved additional effect due to the pigments: whereas with the use of calcium carbonate, the dynamic printing density decreases to a degree which is still perfectly acceptable, the dynamic printing density is very good with the use of kaolin. On omitting in Comparative Example 2 stearyl gallate as representative of the color acceptor (compounds) according to formula (1) the dynamic printing density decreases unacceptably, while omission of the secondary color acceptor in Comparative Example 1 leads to a distinct increase in the dynamic printing density.

To assess the color loci of the thermal test printouts already examined with respect to dynamic printing density, the measuring instrument used is an Elrepho 3000 (illuminant D 65/10), the thermal test printouts were measured twice, once before and once after seven days of storage at 40° C. and 95% relative humidity. Of note here are the changes of the color locus which, from inspecting the individual values of the L*a*b* color space (as defined in DIN EN ISO 11664-4), is readily recognizable because the L* value tends to represent the lightness of a measured site while the a* value and the b* value represent respectively its red-green orientation and its blue-yellow orientation. The differences regarding the b* components of the L*a*b* values are reported in the last row of table 1. They indicate some unacceptable yellowing in the thermal test printouts of Comparative Example 1, the effect of the secondary color acceptor is missing here, while Comparative Example 2 is virtually devoid of any yellowing, this is where the stearyl gallate ester representing the color acceptor (compounds) of formula (1) is missing. The examples which are in accordance with the present invention show the adverse effect of calcium carbonate—the samples still yellow to a relatively intensive degree, aluminum hydroxide is already Very useful as pigment, while kaolin is outstanding in this context.

It can be stated in summary that the examples confirm the expectations in full and corroborate the advantages of a heat-sensitive recording material as claimed herein.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material comprising:

a web-shaped substrate having a front side and an opposite reverse side;

at least one heat-sensitive recording layer at least one side of the web-shaped substrate; and a color acceptor contained in the at least one heat-sensitive recording layer contains comprising a combination of:

at least one color acceptor (compounds) of formula (1)

formula (1)

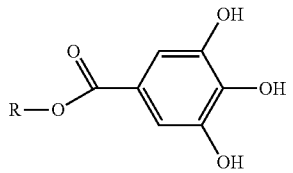

where R is alkyl, and of at least one secondary color acceptor comprising lactic acid oligomers conforming to formula (3)

formula (3)

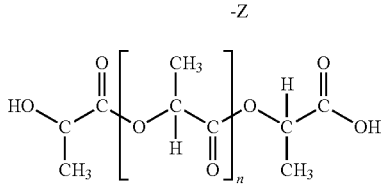

PLA oligomer
1 x Hydroxylgrp.
1 x Carboxylgrp.

$n$ = 4-50 (Lactic acid units).

2. The heat-sensitive recording material as claimed in claim 1, wherein alkyl R in formula (1) comprises 1 to 25 carbon atoms.

3. The heat-sensitive recording material as claimed in claim 2, wherein the at least one heat-sensitive recording layer contains a color acceptor comprising a combination at least of at least one color acceptor (compounds) of formula (1)

formula (1)

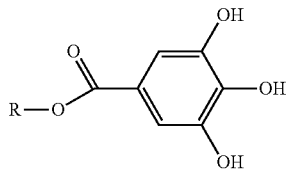

where R is alkyl, and of at least one secondary color acceptor comprising a molecule or formed from a molecule from an n-basic acid and from lactic acid oligomers grouped n-fold around the acid and conforming to formula (3)

formula (3)

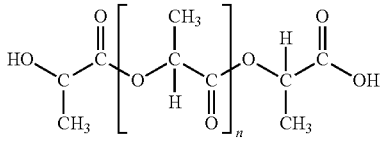

PLA oligomer
1 x Hydroxylgrp.
1 x Carboxylgrp.

$n$ = 4-50 (Lactic acid units).

4. The heat-sensitive recording material as claimed in claim 3, wherein the at least one heat-sensitive recording layer contains a color acceptor comprising a combination at least stearyl gallate, and a molecule as a secondary color acceptor from a central oxalic acid molecule and two oligomers of lactic acid.

5. The heat-sensitive recording material as claimed in claim 3, wherein the at least one heat-sensitive recording layer contains a color acceptor comprising a combination at least:

stearyl gallate, and a molecule as secondary color acceptor from a central citric acid molecule and three oligomers of lactic acid.

6. The heat-sensitive recording material as claimed in claim 1, wherein the at least one heat-sensitive recording layer contains a color acceptor comprising a combination at least of at least one color acceptor (compounds) of formula (1) formula (1):

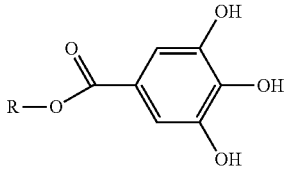

where R is alkyl, and of at least one secondary color acceptor comprising a molecule or formed from a molecule from an n-basic acid and from lactic acid oligomers grouped n-fold around the acid and conforming to formula (3)

formula (3)

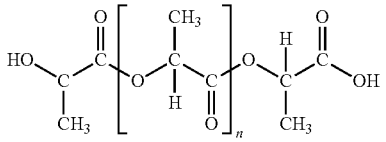

PLA oligomer
1 x Hydroxylgrp.
1 x Carboxylgrp.

$n$ = 4-50 (Lactic acid units).

7. The heat-sensitive recording material as claimed in claim 1, wherein the at least one heat-sensitive recording layer contains a color acceptor comprising a combination at least stearyl gallate, and a molecule as a secondary color acceptor from a central oxalic acid molecule and two oligomers of lactic acid.

8. The heat-sensitive recording material as claimed in claim 1, wherein the at least one heat-sensitive recording layer contains a color acceptor comprising a combination at least:

stearyl gallate, and a molecule as secondary color acceptor from a central citric acid molecule and three oligomers of lactic acid.

9. The heat-sensitive recording material as claimed in claim 1, wherein a wt % (bonedry) ratio of color acceptor compounds conforming to formula (1) to secondary color acceptors comprising lactic acid oligomers conforming to formula (3) is in a range from 3.25:1 to 1:1.

10. The heat-sensitive recording material as claimed in claim 1, wherein the at least one heat-sensitive recording layer includes a dye precursor comprising at least one substance selected from the list comprising:

3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

11. The heat-sensitive recording material as claimed in claim 10, wherein a wt % (bonedry) ratio of fluoran-based dye precursor to the color acceptor compounds conforming to formula (1) is in a range from 1:1.5 to 1:2.5.

12. The heat-sensitive recording material as claimed in claim 10, wherein the at least one heat-sensitive recording layer contains a binder comprising a substance selected from the list comprising:

polyvinyl alcohol, ethylene-vinyl alcohol copolymer and a combination of polyvinyl alcohol and ethylene-vinyl alcohol copolymer.

13. The heat-sensitive recording material as claimed in claim 12, wherein the at least one heat-sensitive recording layer further comprises a pigment.

14. The heat-sensitive recording material as claimed in claim 13, wherein the pigment in the at least one heat-sensitive recording layer is a pigment selected from the list consisting of kaolin and aluminum (hydr)oxide.

15. The heat-sensitive recording material as claimed in claim 13, wherein an amount of pigment in the at least one heat-sensitive recording layer is in a range extending from 8 to 18 wt % (bonedry), based on an overall weight of the at least one heat-sensitive recording layer.

16. The heat-sensitive recording material as claimed in claim 14, wherein an amount of pigment in the at least one heat-sensitive recording layer is in a range extending from 8 to 18 wt % (bonedry), based on an overall weight of the at least one heat-sensitive recording layer.

17. The heat-sensitive recording material as claimed in claim 1, wherein the heat-sensitive recording material further includes a pigment-containing interlayer disposed between the web-shaped substrate and the at least one heat-sensitive recording layer.

* * * * *